US008201387B2

(12) United States Patent
Passoni

(10) Patent No.: US 8,201,387 B2
(45) Date of Patent: Jun. 19, 2012

(54) METHOD FOR THE AUTOMATIC ENVELOPING OF SMALL ITEMS SUCH AS DOCUMENTS AND DEVICE USED TO IMPLEMENT SAME

(75) Inventor: Gianfranco Passoni, Chatillon (CH)

(73) Assignee: Kern AG, Konolfingen (CH)

( * ) Notice: Subject to any disclaimer, the term of this patent is extended or adjusted under 35 U.S.C. 154(b) by 218 days.

(21) Appl. No.: 10/572,419

(22) PCT Filed: Sep. 14, 2004

(86) PCT No.: PCT/CH2004/000579

§ 371 (c)(1),
(2), (4) Date: Mar. 20, 2006

(87) PCT Pub. No.: WO2005/025889

PCT Pub. Date: Mar. 24, 2005

(65) Prior Publication Data

US 2006/0254223 A1 Nov. 16, 2006

(30) Foreign Application Priority Data

Sep. 18, 2003 (FR) ..... 03 10961

(51) Int. Cl.
*B65B 11/48* (2006.01)
*B65B 43/26* (2006.01)

(52) U.S. Cl. ..... 53/460; 53/381.7; 53/381.6; 53/381.5

(58) Field of Classification Search ..... 53/460, 53/569, 206, 284.3, 381.3, 5, 6, 381.5, 381.6
See application file for complete search history.

(56) References Cited

U.S. PATENT DOCUMENTS

| | | | | |
|---|---|---|---|---|
| 2,643,119 | A | 6/1953 | Morrison | |
| 3,253,384 | A | 5/1966 | Huck et al. | |
| 3,381,447 | A | 5/1968 | Ash et al. | |
| 3,423,900 | A * | 1/1969 | Orsinger | 53/473 |
| 3,962,848 | A | 6/1976 | Hankins | |
| 4,524,691 | A * | 6/1985 | Miller | 101/232 |
| 4,649,691 | A | 3/1987 | Buckholz | |
| 4,750,340 | A * | 6/1988 | Anderson | 68/43 |
| 4,813,209 | A * | 3/1989 | Foster et al. | 53/381.7 |

(Continued)

FOREIGN PATENT DOCUMENTS

DE 10 00 260 B 1/1957

(Continued)

*Primary Examiner* — Rinaldi I. Rada
*Assistant Examiner* — John Paradiso
(74) *Attorney, Agent, or Firm* — Davis & Bujold, P.L.L.C.

(57) ABSTRACT

The invention relates to an automatic device which is used to envelope small items and which can be used to perform very-high-speed enveloping. The inventive device comprises a frame (11) having the following components mounted thereto, namely: a storage bin (12) containing a pile of stacked envelopes (15) which are disposed such that they can be removed one by one from the base of the bin, and a control drum (13) which is associated with a rotary cam (14). The aforementioned control drum (13) is arranged such as to move the envelopes (15) individually and successively from the storage bin (12) towards an area where a document is inserted therein and such as to open the envelope when the rotary cam (14) has unfolded the flap of same. The documents (30) to be inserted into the envelopes (15) are conveyed by way of cogs (32) which are solidly connected to a continuously-moving transport chain (31).

20 Claims, 9 Drawing Sheets

U.S. PATENT DOCUMENTS

| | | | | |
|---|---|---|---|---|
| 4,915,369 | A * | 4/1990 | Rutishauser | 271/2 |
| 5,447,015 | A * | 9/1995 | Belec et al. | 53/492 |
| 6,036,185 | A * | 3/2000 | Baumann et al. | 271/2 |
| 6,199,348 | B1 * | 3/2001 | Button et al. | 53/460 |

FOREIGN PATENT DOCUMENTS

| | | |
|---|---|---|
| EP | 1 332 891 | 8/2003 |
| WO | WO 02/087973 | 11/2002 |

* cited by examiner

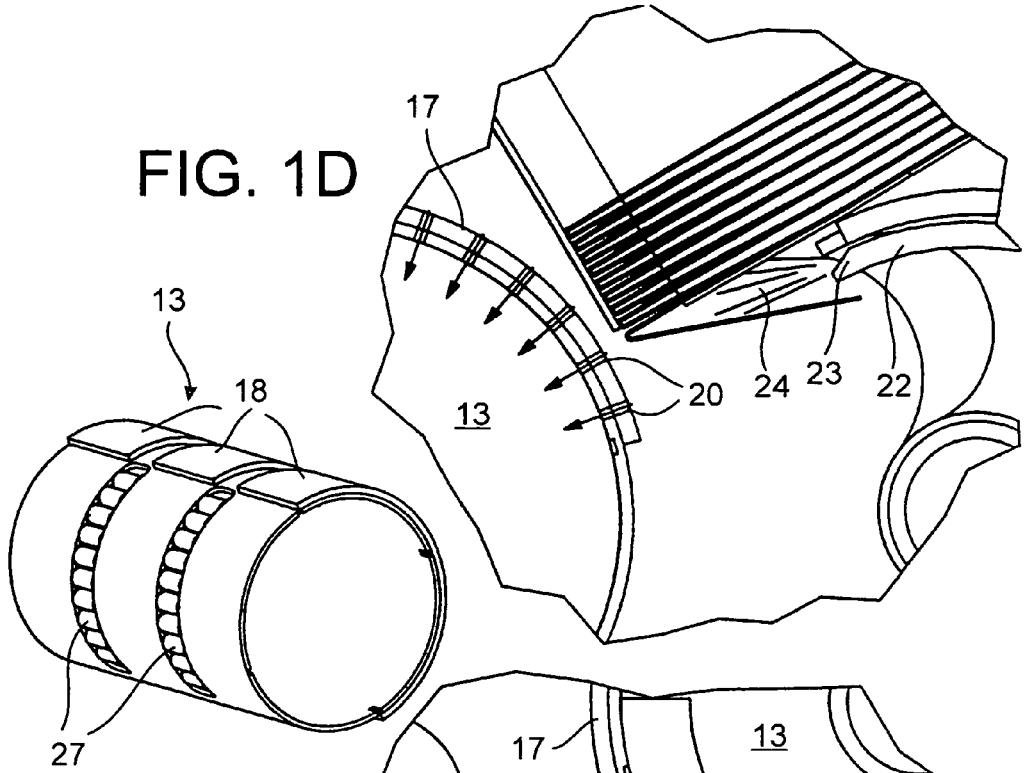
FIG. 1D
FIG. 1F
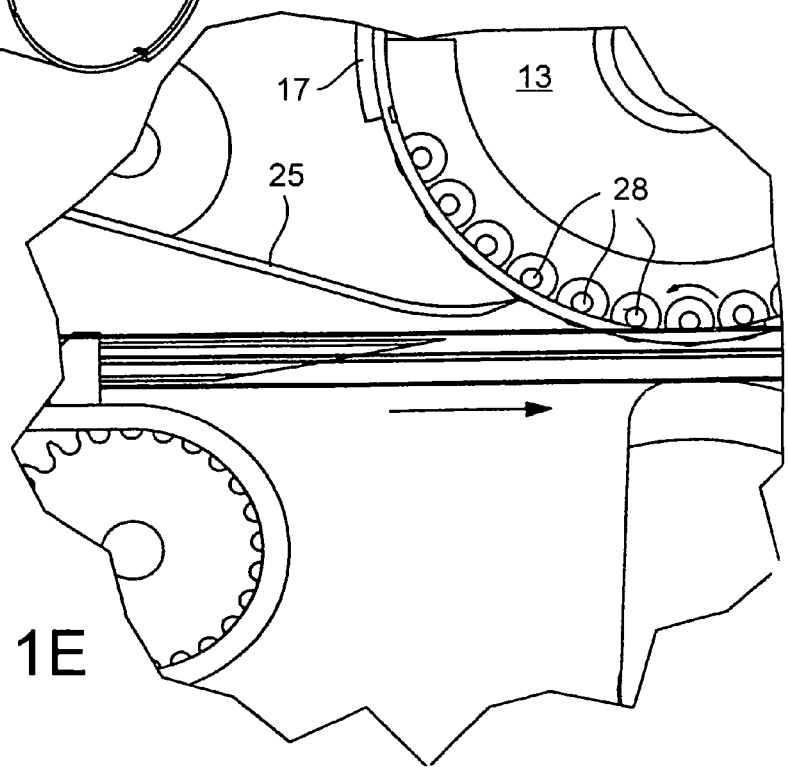
FIG. 1E

METHOD FOR THE AUTOMATIC ENVELOPING OF SMALL ITEMS SUCH AS DOCUMENTS AND DEVICE USED TO IMPLEMENT SAME

This application is a national stage completion of PCT/CH2004/000579 filed Sep. 14, 2004 which claims priority from French Application Serial No. 03/10961 filed Sep. 18, 2003.

TECHNICAL DOMAIN

The present invention concerns a method for automatically inserting small objects into envelopes, particularly documents or objects to be transmitted in envelopes using a mailing service, by utilizing a device that comprises a storage means and a means for successively feeding individual envelopes, a means for moving the documents or objects to be transmitted toward the individual envelopes comprising a folded closing flap, and a means for introducing one of the documents or one of the objects into one of the envelopes.

It also concerns the device implementing this method.

PRIOR ART

Devices of this type for inserting letters, publicity material, or the like into envelopes for large scale distribution are already known in the art. These devices are generally complicated in design and comprise a large number of moving mechanical parts to guide and feed the envelopes on the one hand and the documents on the other hand toward the zone where the two delivery components meet, called the packaging zone. Since the paths taken by the envelopes and by the documents are separate, whereas the packaging area is a common one, in currently used devices the envelopes are usually first moved along a trajectory in the direction opposite to that of the documents and then along a trajectory identical to that of the documents after the documents have been introduced inside the envelopes. This reversal of direction generally requires the use of a switching mechanism to separate the arrival and departure paths of the envelopes.

Such a design is complicated and it operates slowly, considerably reducing the speed of the packaging operation. In practice, with this system each cycle must be completely finished before the next cycle can start up, that is, one envelope must be filled with the documents intended for it and evacuated from the packaging zone before the next envelope can be delivered to this same zone to receive its documents. The resulting reduced speed, in addition to the complicated equipment design, makes the equipment difficult to maintain and subject to frequent breakdowns.

U.S. Pat. No. 2,643,119 describes a packaging device comprising several units with a storage unit for obliquely arranged envelopes which are removed one at a time using a rotary drum. An air blower is located behind the zone where the envelopes stop in order to open them and allow them to receive the letters or documents to be placed inside. However, this device has several drawbacks. The envelopes are removed while they are closed and through gravitational force pass in groups from a first platform to a second platform where they are taken up by the drum. There is a considerable risk that several envelopes will be selected simultaneously, causing a jam. Furthermore, the envelopes, which are transferred while closed, are not opened by the blower until the moment they arrive at the stop. This sequence reduces speed and creates a high risk that the envelopes will fail to open.

The objective of U.S. Pat. No. 3,423,900 is to achieve a machine that can insert into an envelope several documents, cards, or letters that are separately stored. The envelopes are transported by a rotary drum equipped with a mechanical gripping means and which comprises grooves for the envelope flaps. The documents and the envelopes are driven towards a zone for filling the envelopes with the documents. This machine is completely mechanical and all the operations of the maintenance or gripping fingers are controlled by cams. This procedure, however, does not allow work to progress at a very high speed.

U.S. Pat. No. 4,649,691 concerns an automatic envelope filling machine in which the envelopes are removed mechanically using claws attached to a rotary drum. The envelope is opened by blowers that raise the flap when it arrives in the position for receiving documents. It does not provide any mechanical control to guaranty that the envelope is correctly opened.

U.S. Pat. No. 3,962,848describes a device wherein envelopes stacked in a column are removed using friction from a rotary drum, opened by a blower, and transported on a conveyor. This system is based only on friction and cannot work reliably at high speed.

The automatic envelope filling machine which is the subject of U.S. Pat. No. 3,381,447 comprises a first drum for removing an item from stored instruction inserts or the like, and a second drum for removing envelopes. The instruction inserts are fed towards a wheel with radial cavities through which the envelopes have been introduced previously, the cavities comprising opening means. Such a device is relatively slow because the envelopes and the documents introduced inside them must be inserted into and then withdrawn from the cavities in the rotating wheel, which cannot be done continuously and thus requires time to stop the wheel.

EXPLANATION OF THE INVENTION

The objective of the present invention is to eliminate the disadvantages of these known devices by providing a simple, effective device that is easy to maintain and is capable of automatically filling envelopes at a very high speed.

This goal is achieved by the method defined in the preamble and characterized in that the envelopes are stored in such a way that the flap of each individual envelope is located on the bottom of the envelope and towards the front in the direction of removal, in that the flap is unfolded downward in the direction in which the envelope opens, in that the envelope flap is moved into contact with the control drum, in that each envelope is displaced individually and successively by pulling its flap placed against the exterior surface of the control drum towards the zone for introducing the documents or objects, in that the envelope is then opened and the document or the object is then introduced inside the previously opened envelope.

Advantageously, the envelope flap is unfolded by at least one stream of air and flattened against the surface of the positioning drum by means of radial suction produced inside the drum.

Preferably, the envelopes are detached from the positioning drum using at least one scraper that is tangential relative to the drum surface.

It is possible to open each envelope using opening guides, and the envelope can also be compressed laterally.

The device for implementing this method of automatically inserting small objects into envelopes, particularly documents or objects to be sent by a mailing service, is characterized in that the means for feeding the individual envelopes consists of a control drum design to displace the envelopes individually and successively from the storage means towards the zone for introduction of one of the documents or one of the objects into one of the individual envelopes, and in that the means for introducing one of these documents or one of these objects into one of the envelopes comprises a means for unfolding the flap of the individual envelope and opening this envelope.

According to a preferred embodiment, the control drum comprises at least one peripheral zone that is perforated with openings and the openings are connected to a suction device in an intermediate zone between the storage means and the zone for introducing one of the documents into one of the individual envelopes.

According to an advantageous embodiment, the openings are connected to a pressurized air generating device in the zone for introducing one of the documents into one of the individual envelopes.

The control drum preferably comprises on at least a portion of its periphery a covering with a high coefficient of friction.

According to one advantageous embodiment, the peripheral covering on the control drum extends over an angular section comprising from 25% to 75% of the periphery.

According to a particular embodiment, the peripheral coating on the control drum comprises several parallel bands extending over an angular section comprising from 25% to 75% of the periphery.

The means for opening the individual envelopes preferably comprises at least one rotary cam designed to engage beneath the flap of each individual envelope in order to unfold it.

In order for one envelope to be taken up during each cycle that corresponds to one rotation by the control drum, the rotary cam is driven synchronously with the drum.

According to a particularly advantageous design, the rotary cam is equipped with at least one organ that generates at least one stream of air to assist in unfolding the flap of each individual envelope in order to open it.

The rotary cam is preferably equipped with at least one projection to initiate the unfolding of the flap of the individual envelope.

Preferably, the control drum and the rotary cam have the same diameter and are driven synchronously at the same speed and, on one portion of their circular trajectory, the rotary cam contacts the peripheral surface of the control drum to drive one envelope from the storage means towards the introduction zone.

To detach the envelopes from the control drum, the device advantageously comprises at least one scraper which detaches the individual envelope from the control drum in the introduction zone.

Advantageously, the device comprises several scrapers parallel to each other, the scrapers being located between the parallel bands of the covering on the control drum.

To facilitate opening the envelope, the device may comprise lateral deflectors for pushing together the lateral edges of the individual envelopes to assist in opening them.

According to a first embodiment, the lateral deflectors comprise guide rollers.

According to a second embodiment, the lateral deflectors comprises guide sections.

According to a particular embodiment, the control drum comprises at least two cylindrical sections that are separated by at least one unattached ring.

SUMMARY DESCRIPTION OF THE DRAWINGS

The present invention and its features will be better understood from the description of its preferred embodiments, furnished by way of non-limiting examples, with reference to the attached drawings, wherein:

FIGS. 1D, 1E and 1F are enlarged partial views of certain portions of the device of FIG. 1A in particular positions corresponding to operational phases of the device;

HOW TO ACHIEVE THE INVENTION

Figure 1A:
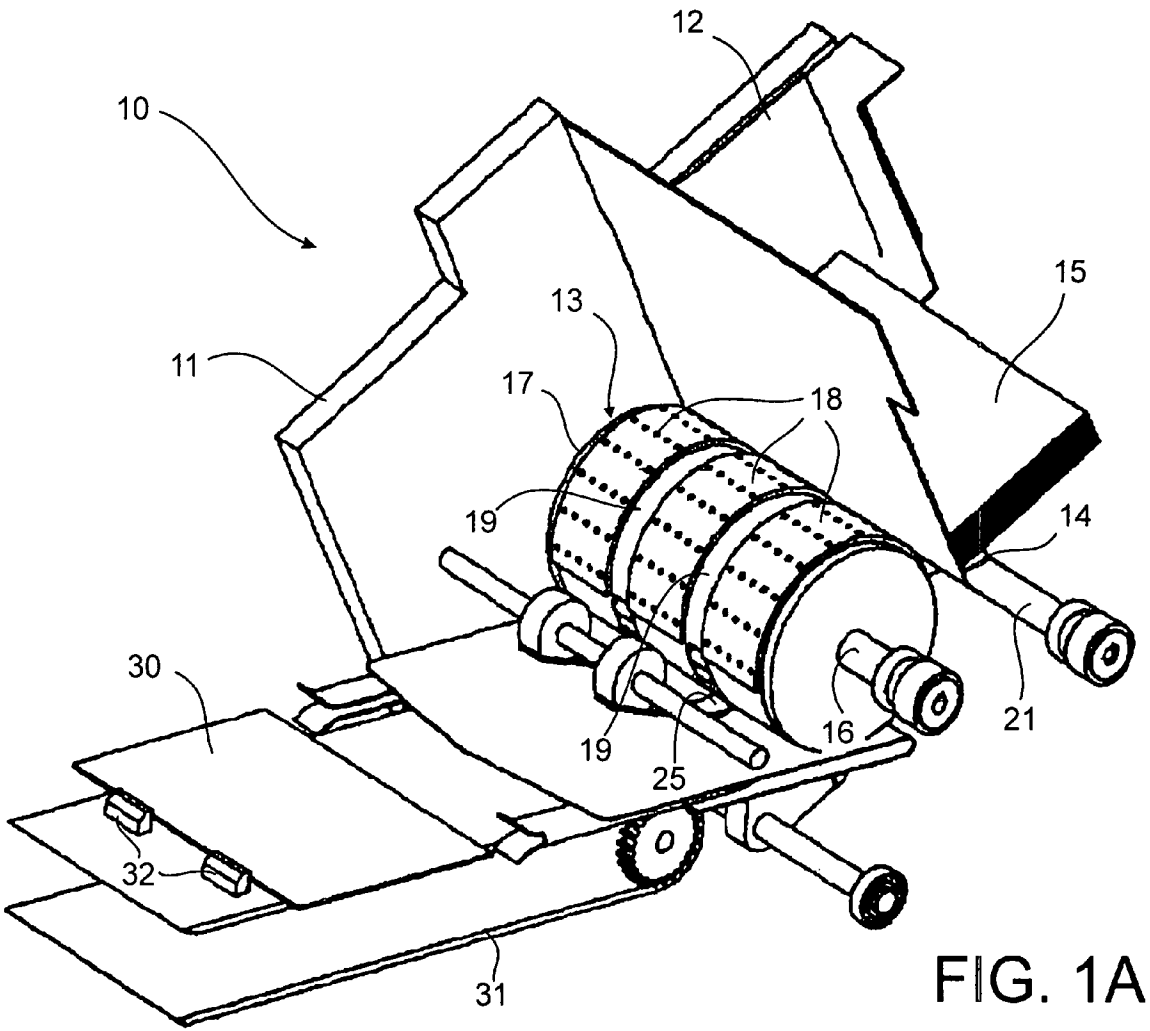
FIG. 1A is a partial perspective representing the principal elements constituting a first embodiment of the device according to the invention.
Figure 1B:
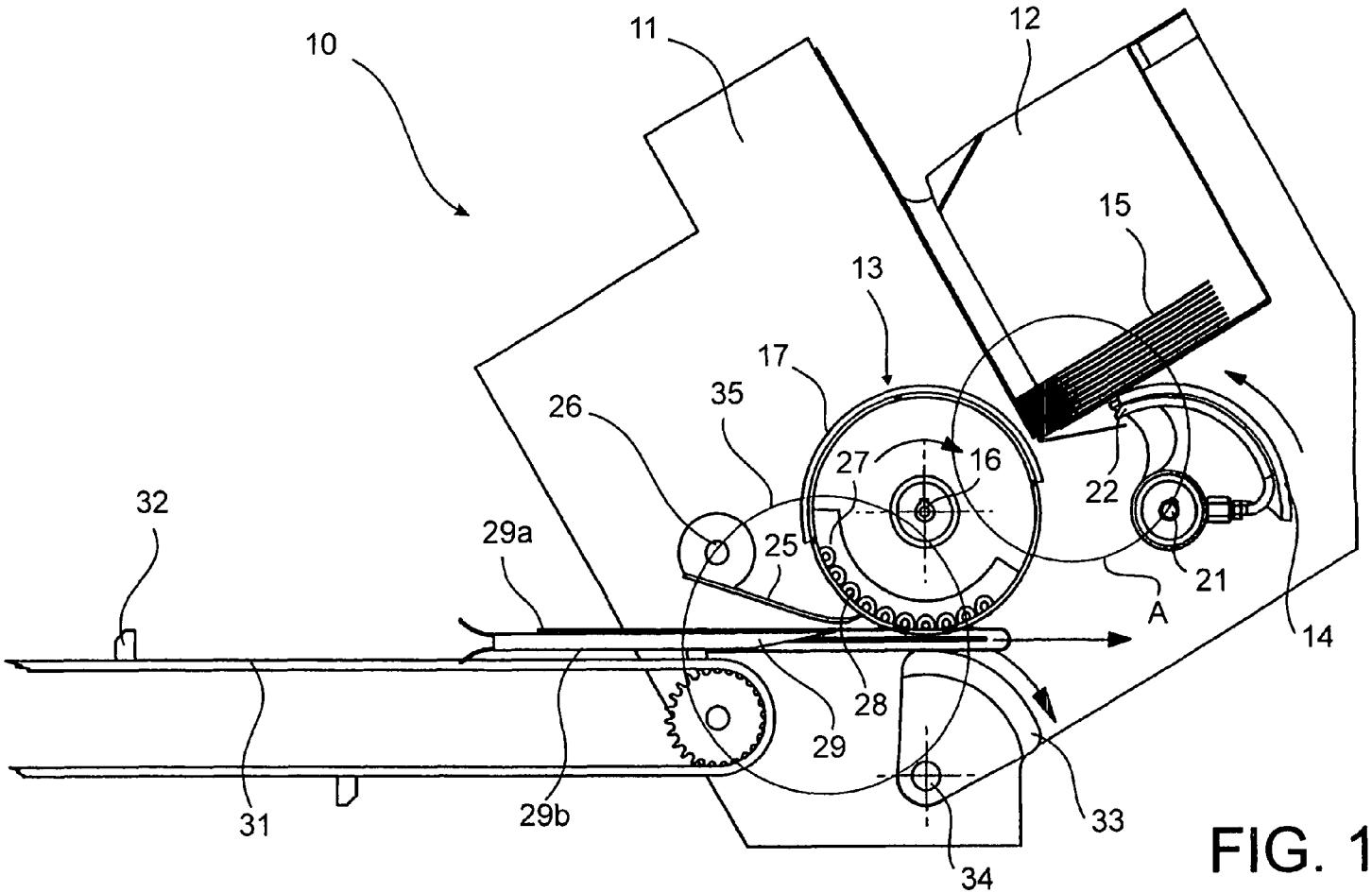
FIG. 1B is an elevation of the device of FIG. 1A shown in a particular phase of operation.
Figure 1C:
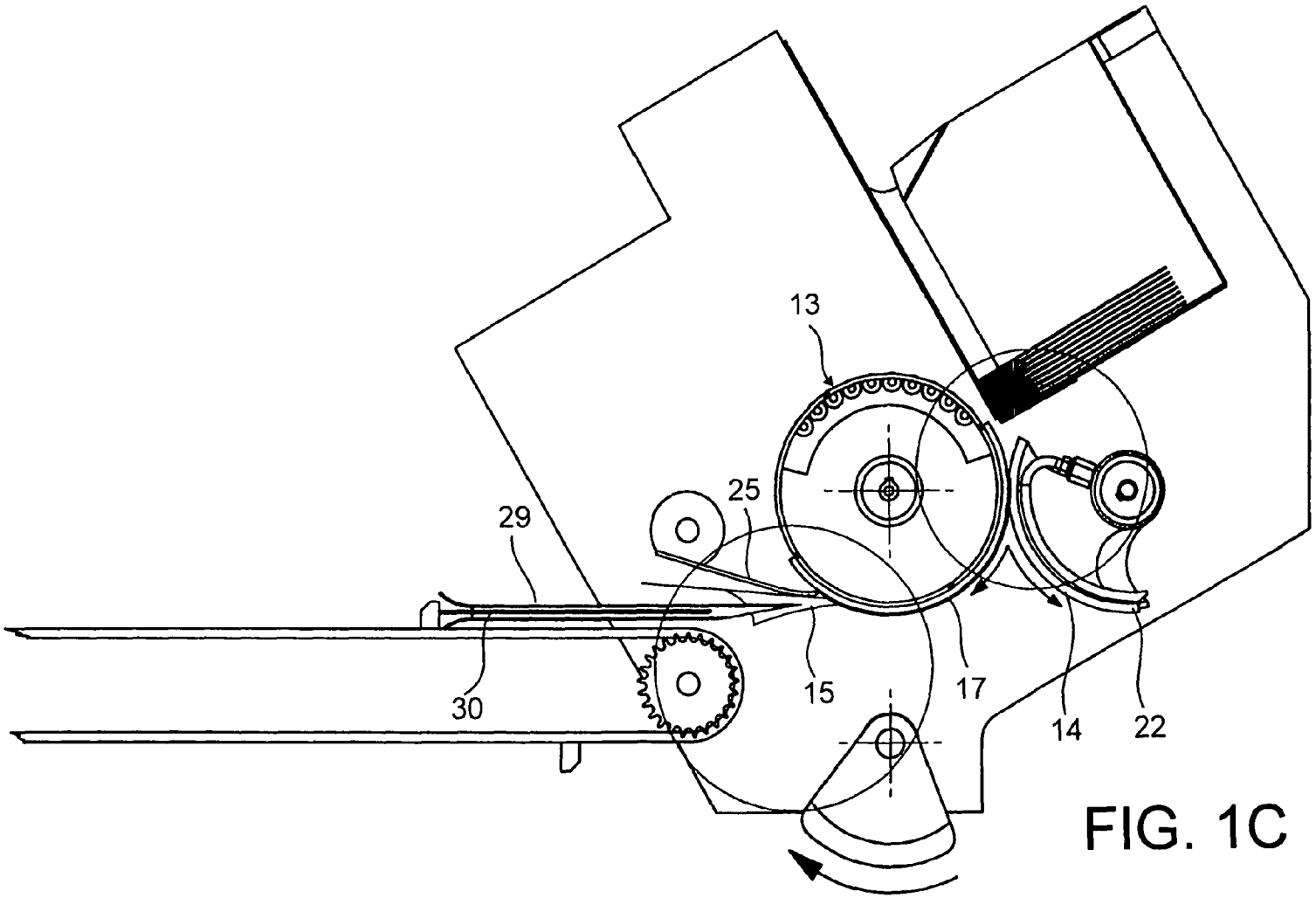
FIG. 1C is an elevation of the device of FIG. 1A shown in another particular phase of operation.
Figure 1G:
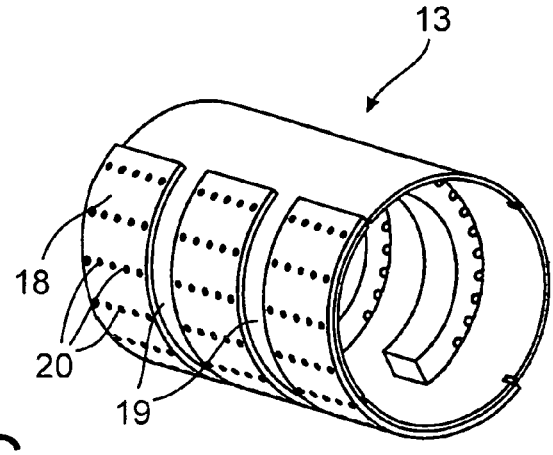
FIG. 1G is a detailed view showing one element of the device of FIG. 1A.
Figure 1H:
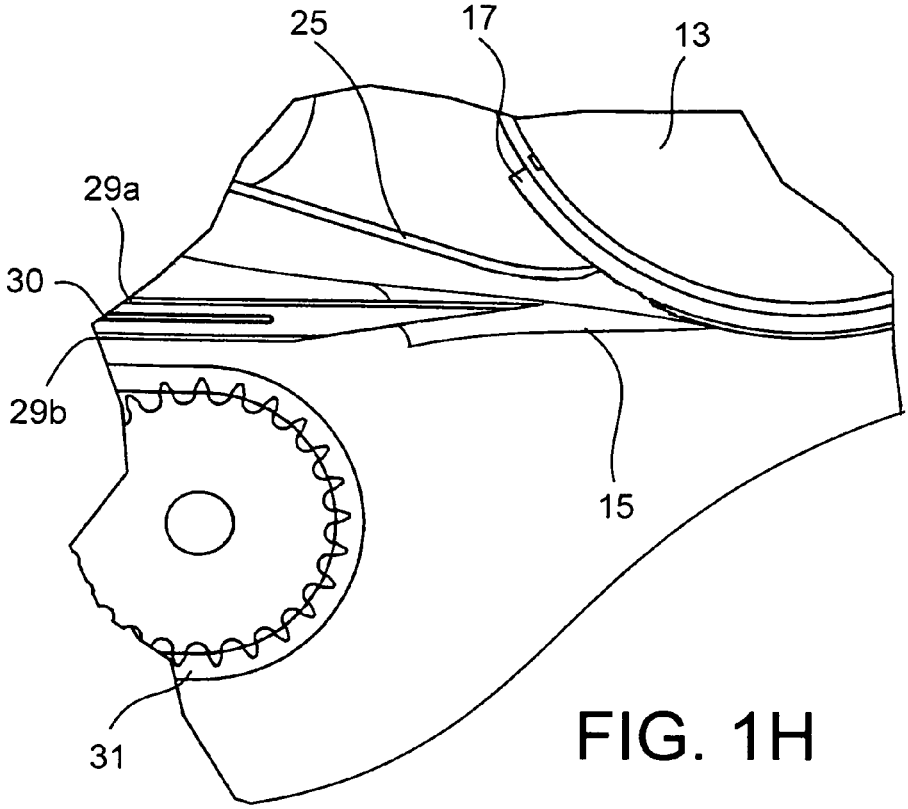
FIG. 1H shows one portion of the device of FIG. 1A during operation.
Figure 1I:
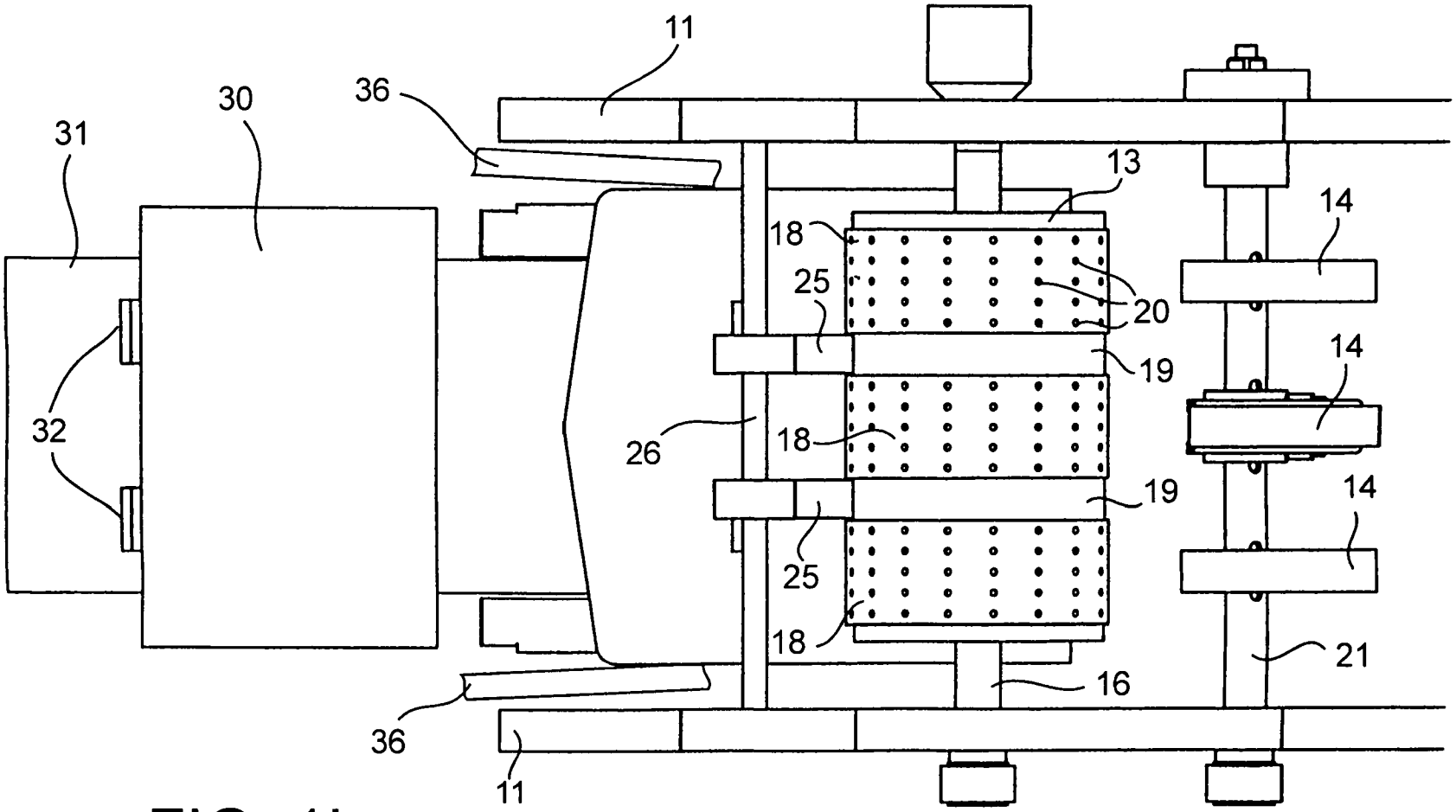
FIG. 1I is a plane view from the top of the device of FIG. 1A.
Figure 1J:
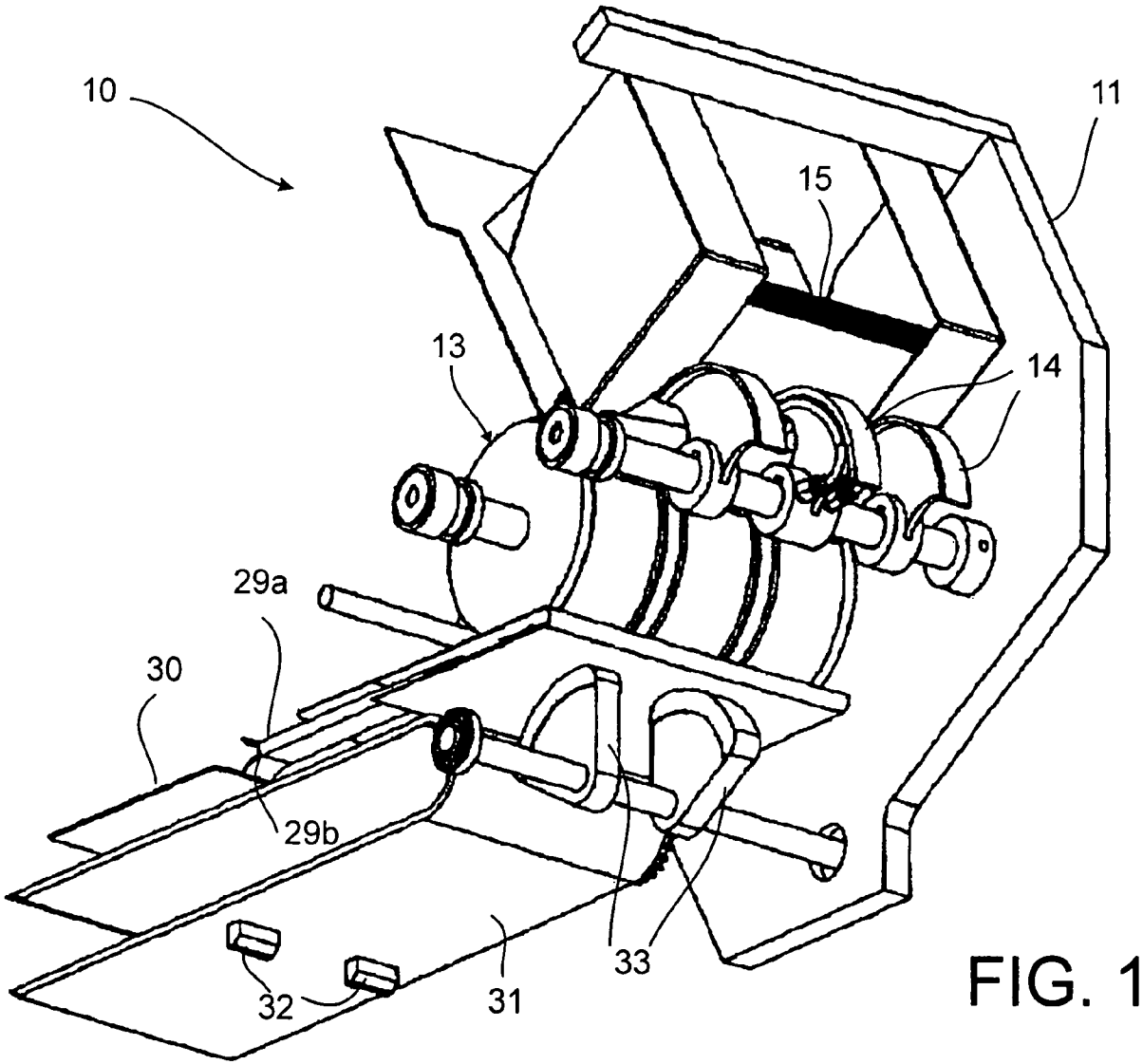
FIG. 1J is a perspective view from below showing the device of FIG. 1A during operation.

With reference to FIGS. 1A through 1J, device 10 consists principally of a frame 11, shown schematically by a lateral support element, but which may comprise as shown in FIG. 1I two lateral support elements that are parallel and essentially identical, to which a storage bin 12 for envelopes or packets is attached, the bin constituting the storage and delivery means, a control drum 13, and at least one rotary cam 14. Storage bin 12 may contain a stack of superimposed envelopes 15 arranged so they may be removed one at a time from the base of the bin. The storage bin is open at the base, allowing rotary cam 14 to access envelope 15 located at the lower part of the stack. Each envelope is arranged so its closing flap is folded down against the envelope surface.

Cylindrical control drum 13 is attached to a rotary shaft 16 supported by frame 11. It may be made of metal or synthetic material, for example, a carbon fiber based-material or the like. It comprises an exterior covering 17 consisting of a material with a high coefficient of friction, such as, for example, foam rubber or the like. This exterior covering 17 preferably extends along only one portion of the drum periphery, for example, along an angular section ranging from 25% to 75% and preferably of the order of 50%. The covering advantageously takes the form of several parallel bands 18 which may be three in number, separated by annular spaces 19. Drum 13 is perforated and in the area with the covering, it comprises a plurality of openings 20 penetrating exterior covering 17. These openings communicate with the hollow interior of control drum 13 and because of this they are connected through a turning connection to a suction device (not shown) when the control drum is in an intermediate zone between the storage means and the zone for introduction of one of the documents into one of the individual envelopes 15.

When the control drum 13 is located in the zone for introduction of one of the documents into one of the individual envelopes, the openings 20 are connected through a turning connection to a pressurized air delivery device which detaches the envelope from the control drum.

Rotary cams 14, which number three in the embodiment shown, are attached to a shaft 21 supported by the frame 11 and are driven in synchronous rotation with the control drum 13.

The mechanism which drives and connects the two shafts 16 and 21 is shown schematically by a circle A. The rotary cams 14 comprise a projection 22 which initiates the unfolding of the flap of each individual envelope during each operational cycle by the device. This projection 22 is equipped with at least one nozzle 23 producing a stream of air 24 (see FIG. 1D) designed to contribute to the unfolding of each individual envelope flap in order to open the envelope. This nozzle 23 is supplied with compressed air through a turning connection (not shown) attached to shaft 21.

Device 10 further comprises at least one scraper 25 designed to detach the individual envelope from the control drum 13 in the introduction zone. In the exemplary embodiment described, it comprises two parallel scrapers 25 attached to an axle 26 supported by frame 11. These scrapers consist of a thin plate slightly curved at its free end that contacts the peripheral surface of control drum 13.

In the example shown, control drum 13 comprises, on one portion of annular spaces 19, bearing supports 27 or roller supports 28 that rotate freely, which are level with the peripheral drum surface and over which scrapers 25 can slide without engaging. The function of these unattached bearings or rollers 28 is to facilitate detachment of the individual envelopes from the drum in the zone for introduction of documents or objects into the envelopes.

Parallel bands 18 of exterior coating 17 on control drum 13 form an extra layer and define two hollow annular spaces 19. The unattached ends of the plates constituting scrapers 25 contact the peripheral drum surface in the two hollow annular spaces 19. The number of these hollow annular spaces depends upon the number of parallel bands 18 of exterior covering. This number is not critical and there should be a minimum of two.

In the zone for introduction of one of the documents into one of the individual envelopes 15, the device is equipped with two opening guides 29 each comprising two branches 29*a* and 29*b*, converging at one extremity to define a projection for opening the envelopes. Documents 30 to be introduced in the individual envelopes are delivered in known manner along rails or some type of support and guide surface 31, for example, a conveyor belt, and are driven by cogs 32 integral with this endless conveyor belt. The filled envelopes are then taken up by a recovery cam 33 rotating on shaft 34, which rotates synchronously with control drum 13. The synchronous driving of shaft 16 for drum 13 and shaft 34 for recovery cam 33 is shown schematically by circle 35.

As shown more particularly by FIG. 11, device 10 is further equipped with two lateral deflectors 36 which push the lateral edges of the envelopes together to help open them. These deflectors consist of guide profiles, but they may also be equipped with rollers to reduce the friction of contact with the envelope.

During one operating cycle the device operates according to the principle of the invention wherein the envelopes are stored in such a way that the flap of each individual envelope is on the bottom of the envelope and towards the front in the direction of removal, the flap is unfolded downwards in the direction in which the envelope opens, the envelope flap is moved into contact with the surface of the control drum, the envelopes are individually and successively displaced by pulling the flaps placed against the exterior surface of the control drum towards the zone for introduction of one of the documents or the envelopes, the envelopes are then opened and the documents or the objects are introduced inside the previously opened envelopes.

Consequently, to effect this series of operations, the elements comprising device 10 operate as follows:

Rotary cams 14 turn counterclockwise so that projections 22 move closer to the flap of the lower envelope in stack of envelopes 15.

Nozzles 23 begin to act and emit a stream of air 24 (see FIG. 1D) that initiates unfolding of the envelope flap.

Projection 22 on rotary cam 14 comes into contact with the flap and completes the unfolding.

The unfolded flap comes into contact with control drum 13 in the zone which has exterior covering 17.

Suction passing through holes 20 of the drum then flattens the unfolded flap against control drum 13 and the entire envelope is then sandwiched between the drum and rotary cams 14.

The envelope arrives at the document introduction zone and lateral deflectors 36 press in opposing directions against the lateral envelope edges to initiate opening.

Scrapers 25 detach the flap and then the entire envelope from control drum 13. The scrapers are assisted in this function by compressed air blown through openings 20 formed in the peripheral wall of the drum and exterior covering 17.

The envelope is speared by opening guides 29 which complete the envelope opening by engaging their two branches 29*a* and 29*b* in the envelope opening and positioning it at the stop so it will be ready to receive documents 30.

The documents 30 arrive and engage with the open envelope.

The envelope is then driven by cogs 32 of conveyor belt 31 which has fed the documents.

The envelope containing documents 30 is evacuated through the action of uptake cam 33 which contacts unattached bearings or rollers 28 on control drum 13. The bearings or rollers 28 rotate freely so as not to impede the envelope evacuation process activated by uptake cam 33.

During these later phases when the envelope is detached from control drum 13, the first phases of the next cycle may be already underway, allowing work to take place in condensed time and reducing the effective duration of a cycle, thereby increasing the speed of the device.

In the example shown in FIGS. 2A through 2D all the components of device 50 are identical to those of device 10 described above, except control drum 53 differs in design and function from control drum 13.

With reference to the drawings, the device 50 principally comprises a frame 51 shown schematically by a lateral support element to which there are attached a bin 52 for storing envelopes or packets, the bin constituting the storage and conveyance means, a control drum 53 and at least one rotary cam 54. Storage bin 52 may contain for example a stack of superimposed envelopes 55 arranged so they may be removed one by one from the base of the bin. The base of the storage bin is open, allowing rotary cam 54 to access envelope 55 located at the lower portion of the stack. Each envelope is positioned so that its closing flap is folded against the body of the envelope.

Cylindrical control drum 53 is attached to a rotary shaft 56 supported by frame 51. Like drum 13, it has an exterior covering 57 consisting of a material with a high coefficient of friction which preferably extends along a portion of its periphery.

The coating 57 advantageously takes the form of several parallel bands 58, which may be three in number, separated by annular spaces. The drum is perforated and in the covered zone it comprises a plurality of openings 60 penetrating the exterior covering. These openings communicate with the hollow interior of control drum 53 and for this reason they are connected by a turning connection to a suction device (not shown) when the control drum is in an intermediate zone between the storage means 52 and the zone for introducing documents into one of the individual envelopes.

Rotary cams 54, which are three in number in the embodiment shown, are attached to a shaft 61 supported by the frame 51 and driven to rotate synchronously with the control drum 53. The rotary cams 54 comprise a projection 62 to initiate the unfolding of each individual envelope during each cycle of operation by the device. The projection 62 is equipped with at least one nozzle 63 producing a stream of air 64 (see FIG. 2D) which assists in unfolding the flap of each individual envelope in order to open the envelope.

Device 50 further comprises at least one scraper 65 for detaching the individual envelope from the control drum 53 in the introduction zone.

In the zone for introduction of one of the documents into one of the individual envelopes, the device is equipped with two opening guides 69 each comprising two branches 69*a* and 69*b* that reconnect at one of their extremities to define an envelope opening projection. The documents to be introduced into the individual envelopes are moved in known manner along rails or any sort of support and guide surface 71, for example a conveyor belt, and are driven by cogs 72 integral with the endless conveyor belt. The filled envelopes are then taken by an uptake cam 73 rotating on shaft 74 which rotates synchronously with control drum 53.

Figure 2A:
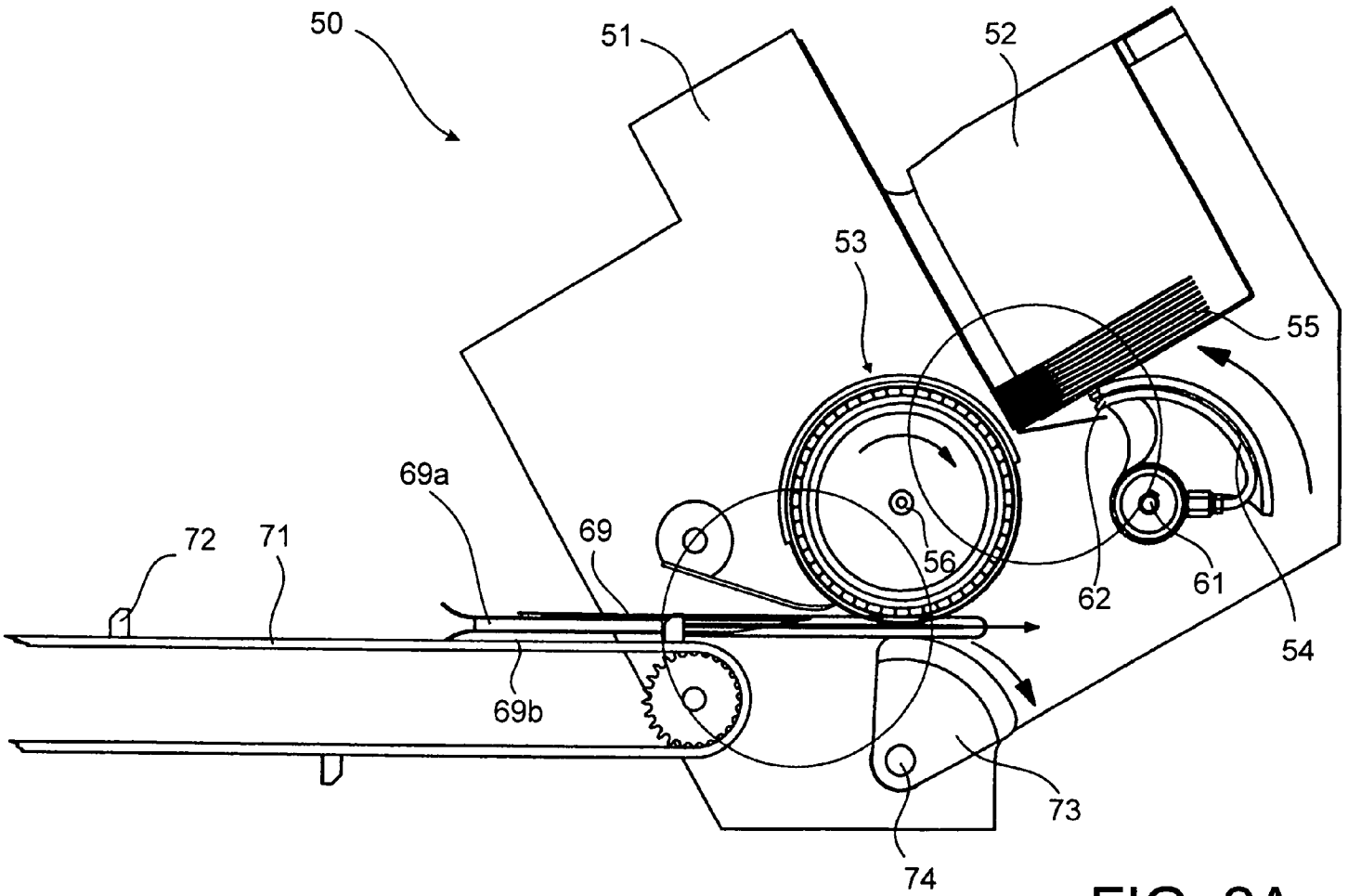
FIG. 2A is a partial perspective showing the principal elements constituting a second embodiment of the device according to the invention.
Figures 2B, 2C, 2D:
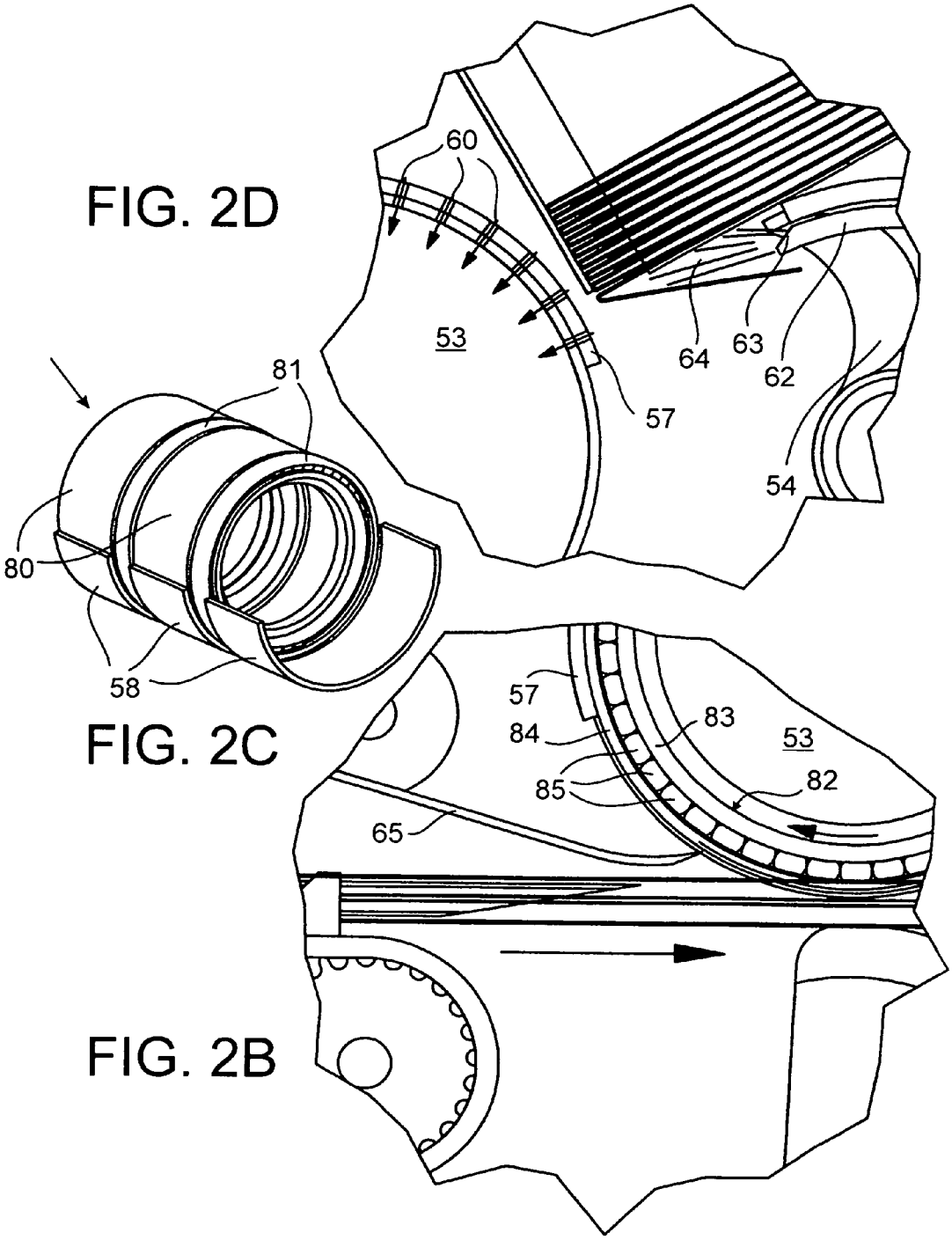
FIGS. 2B, 2C and 2D are enlarged partial views of certain portions of the device of FIG. 2A in particular positions corresponding to operational phases of the device.

As FIGS. 2B and 2C show more specifically, control drum 53 is composed of cylindrical segments 80, which may be three in number, each with a covering 57 along a portion of its periphery and which are separated by unattached rings 81 which are formed in the example shown of a ball bearing with a cage 82 composed of an interior ring 83 and an exterior ring 84 enclosing bearings 85. In this way cylindrical segments 80 and unattached rings 81 can turn independently. The envelopes are in contact with covering 57 along a portion of their trajectory and then, having received the documents, they are in contact with unattached rings 81, or more specifically, they are sandwiched between these rings and uptake cams 73.

The invention claimed is:

1. A method for automatically inserting at least one small item, to be transmitted via a mailing service, into an envelope via a device comprising:

a storage bin for storing envelopes;

an envelope feeding mechanism for successively feeding individual envelopes from the storage bin to a control drum with a periphery of the control drum having at least a vacuum portion, with the control drum being rotatably driven;

an item feeding mechanism for sequentially moving at least one item, to be inserted, toward an envelope being conveyed from the storage bin toward an introduction zone by the vacuum portion of the control drum with a closing flap of the envelope being maintained in an opened position to facilitate insertion of at least one item into the envelope;

an item inserting mechanism for inserting at least one of the items into the envelope being conveyed by the control drum, and the item inserting mechanism comprising at least one guide, located adjacent the control drum and in the introduction zone, for guiding the at least one item into the opened envelope, and at least one scraper located adjacent and contacting an exterior surface of said control drum, for facilitating detachment of the envelope from the vacuum portion of the control drum; and a discharge mechanism for removing the envelope from the introduction zone once the at least one item is inserted into the envelope conveyed by the control drum, said method comprising the steps of:

storing the envelopes such that the closing flap of each individual envelope is in a folded closed position with the closing flap directly abutting a back surface of the envelope and adjacent the control drum, unfolding said closing flap by generating at least one stream of air, which is supplied by a rotary cam and directed at the closing flap, to convey the closing flap from the folded closed position into the opened position, moving said closing flap into contact with an exterior surface of the control drum, drawing said closing flap against said exterior surface of the control drum by suction via the vacuum portion of the control drum, scraping the exterior surface of said control drum with at least one scraper such that, as the control drum rotates, the at least one scraper is introduced between the envelope and the exterior surface of the control drum and the envelope is detached from the control drum, further opening the envelope to facilitate insertion of the at least one item, introducing the at least one item into said opened envelope, and discharging the envelope (15) once the at least one item is inserted into the envelope (15).

2. The method according to claim 1 further comprising the step of opening each envelope by opening guides which are inserted into the envelope to open further the envelope and facilitate insertion of the at least one item therein.

3. The method according to claim 2 further comprising the step of compressing said enveloped laterally during the insertion of the opening guides to facilitate insertion of the at least one item therein.

4. The method according to claim 1, wherein the rotary cam only contacts the exterior surface of the control drum during a portion of each rotation of the rotary cam.

5. A device for automatically inserting at least one small item, to be transmitted via a mailing service, into an envelope via the device, the device comprising:

a storage bin (12, 52) for storing envelopes such that a closing flap of each envelope is folded over into a closed position in which an inner surface of the closing flap directly faces a rear surface of the envelope and an outer surface of the closing flap faces a bottom of the storage bin;

a control drum (13) being driven so as to rotate and a periphery of the control drum (13) having at least a vacuum portion and a roller portion;

a rotary cam (14) for successively unfolding the closing flap of a bottom most envelope, being fed from the storage bin to the control drum (13), with the rotary cam supplying a stream of air to unfold the closing flap, of the bottom most envelope being fed, from the closed position into an opened position while the vacuum portion of the control drum draws the bottom most envelope against an outer surface of the control drum (13);

an item feeding mechanism for sequentially feeding at least one item, to be inserted, toward an envelope (15) being conveyed, by the rotation control drum, from the storage bin toward an introduction zone by the vacuum portion of the control drum (13) with a closing flap of the envelope (15) being maintained in the opened position to facilitate insertion of at least one item into the envelope (15); and an item inserting mechanism for inserting at least one of the items into the envelope (15) being conveyed by the control drum (13), and the item inserting mechanism comprising at least one guide (29), located adjacent the control drum (13) and in the introduction zone, for guiding the at least one item into the opened envelope (15), and at least one scraper (25) being located adjacent and directly contacting an exterior surface of said control drum (13), such that as the control drum rotates, the at least one scraper is introduced between the envelope and the exterior surface of the control drum facilitating detachment of the envelope (15) from the vacuum portion of the control drum (13); and a discharge mechanism for removing the envelope (15), once at least one item is inserted into the envelope (15) conveyed by the control drum (13).

6. The device according to claim 5, wherein said control drum (13, 53) comprises on at least a portion of its periphery a covering (17, 57) having a high coefficient of friction.

7. The device according to claim 6, wherein said peripheral covering (17, 57) on said control drum (13, 53) extends over an angular section comprising between 25% and 75% of the periphery.

8. The device according to claim 6, wherein said peripheral covering (17, 57) on said control drum comprises several parallel bands (18, 58) extending over an angular section comprising at least between 25% to 75% of the periphery.

9. The device according to claim 5, wherein said rotary cam (14, 54) is driven synchronously with said control drum.

10. The device according to claim 5, wherein the device comprises several scrapers (25, 65) arranged in parallel to one another, and said scrapers are located between the parallel bands (18, 58) of said peripheral covering (17, 67) on said control drum.

11. The device according to claim 5, wherein the device comprises lateral deflectors (36) for pushing together the lateral edges of said individual envelopes and assist in opening of the envelope.

12. The device according to claim 11, wherein said lateral deflectors (36) comprise guide rollers.

13. The device according to claim 11, wherein said lateral deflectors (36) comprise guide profiles.

14. The device according to claim 5, wherein said control drum (53) comprises at least two cylindrical segments (80) separated by at least one unattached ring (81).

15. The device according to claim 14, wherein said unattached ring (81) is formed of a roller.

16. The device according to claim 5, wherein the rotary cam only contacts the exterior surface of the control drum during a portion of each rotation of the rotary cam.

17. A device (10, 50) for automatically inserting at least one item into an envelope which is to be transmitted via a mailing service, the device comprising:

a storage bin (12, 52) for storing envelopes such that a closing flap of each envelope is folded over into a closed position in which an inner surface of the closing flap directly faces and communicates with a rear surface of the envelope and an outer surface of the closing flap faces a bottom of the storage bin;

a rotary cam (14) being rotatably supported for successively feeding a bottom most envelope (15) from the storage bin to a control drum (13), a periphery of the control drum having both a vacuum portion and a roller portion and the control drum being rotationally driven, the rotary cam (14) successively unfolding the closing flap of the bottom most envelope, being fed from the storage bin to the control drum (13), the rotary cam has a projection with an air nozzle which directs a stream of air at the closing flap, of the bottom most envelope, to unfold the closing flap from the closed position into the opened position the projection of the rotary cam contacts the inner surface of the closing flap as the rotary cam rotates to further open the closing flap and facilitate communication between the closing flap and the control drum, the vacuum portion of the control drum draws the envelope being fed against an outer surface of the control drum (13);

an item feeding mechanism for sequentially feeding at least one item, to be inserted, toward an envelope being conveyed by the vacuum portion of the control drum from the storage bin toward the item feeding mechanism with a closing flap, of the envelope being conveyed by the control drum, being maintained in an opened position, by vacuum, to facilitate insertion of at least one item into the envelope being conveyed by the control drum at an introduction zone; and an item inserting mechanism for inserting at least one of the items into the envelope being conveyed by the control drum, and the item inserting mechanism comprising at least one guide (29), at least partially located in the introduction zone adjacent the control drum, for guiding the at least one item into the opened envelope, and at least one scraper (25) located tangentially relative to and directly contacting an exterior surface of said control drum such that as the control drum rotates, the at least one scraper is introduced between the envelope and the exterior surface of the control drum, for facilitating detachment of the envelope from the control drum; and a discharge mechanism, cooperating with the roller portion of the control drum, for discharging the envelope, once at least one item is inserted into the envelope conveyed by the control drum, in a discharge direction away from the at least one guide.

18. The device according to claim 17, wherein said rotary cam (14, 54) is provided with at least one projection (22, 62) for initiating the unfolding of the closing flap of each individual envelope.

19. The device according to claim 17, wherein the control drum (13, 53) and the rotary cam (14, 54) have the same diameter and are driven synchronously at the same speed and along one portion of their circular trajectory, said rotary cam (14, 54) contacts with the peripheral surface of said control drum (23, 53) to drive the bottom most envelope from said storage means (12, 52) towards said introduction zone.

20. The device according to claim 17, wherein the rotary cam only directly contacts the exterior surface of the control drum during a portion of each rotation of the rotary cam, a radius of the vacuum portion of the control drum is equal to a radius of the rotary cam, the control drum and the rotary cam rotate at the same speed such that the rotary cam contacts the vacuum portion of the control drum to drive one envelope from the storage bin towards the introduction zone.

* * * * *